US010632338B1

(12) United States Patent
Pinkart

(10) Patent No.: US 10,632,338 B1
(45) Date of Patent: Apr. 28, 2020

(54) EXERCISE STICK

(71) Applicant: Patrick Pinkart, Los Osos, CA (US)

(72) Inventor: Patrick Pinkart, Los Osos, CA (US)

( * ) Notice: Subject to any disclaimer, the term of this patent is extended or adjusted under 35 U.S.C. 154(b) by 41 days.

(21) Appl. No.: 16/162,538

(22) Filed: Oct. 17, 2018

(51) Int. Cl.
*A63B 21/00* (2006.01)
*A63B 21/055* (2006.01)
*A63B 23/02* (2006.01)

(52) U.S. Cl.
CPC .... *A63B 21/4035* (2015.10); *A63B 21/00072* (2013.01); *A63B 21/055* (2013.01); *A63B 23/0211* (2013.01); *A63B 2208/0204* (2013.01)

(58) Field of Classification Search
CPC ..... A63B 21/4035; A63B 21/055; A63B 21/00072; A63B 21/00058; A63B 21/00069; A63B 21/00189; A63B 21/02; A63B 21/0407; A63B 21/0428; A63B 21/0442; A63B 21/0552; A63B 21/0557; A63B 21/1654; A63B 21/1663; A63B 23/0211; A63B 2208/0204; A63B 2210/50; A63B 21/16; A63B 21/1618; A63B 21/1627; A63B 21/1636; A63B 21/1645
See application file for complete search history.

(56) References Cited

U.S. PATENT DOCUMENTS 2,815,022 A * 12/1957 Krumm ..... A61H 1/0218 602/40
3,637,205 A * 1/1972 Bankston ..... A63B 21/012 482/114
3,971,255 A * 7/1976 Varney ..... A61B 5/224 482/114
4,385,760 A * 5/1983 Mattox ..... A63B 21/012 188/67
4,529,194 A * 7/1985 Haaheim ..... A63B 21/012 482/70
4,603,856 A * 8/1986 Fiore ..... A63B 21/015 482/114
4,664,373 A * 5/1987 Hait ..... A63B 21/0603 482/109
4,773,398 A * 9/1988 Tatom ..... A61H 1/0274 482/139
4,944,510 A * 7/1990 Brady ..... A63B 21/018 482/114
5,509,879 A * 4/1996 Lanzagorta ..... A63B 21/015 482/115
5,700,232 A * 12/1997 Clausen ..... A63B 21/0552 482/125
6,193,638 B1 * 2/2001 Barrett ..... A63B 21/0004 482/128
8,708,873 B2 * 4/2014 Birch ..... A63B 21/00185 482/121
9,205,297 B2 * 12/2015 Kaehler ..... A63B 21/02
10,022,578 B2 * 7/2018 Kelly ..... A61H 15/00
(Continued)

*Primary Examiner* — Andrew S Lo
*Assistant Examiner* — Kathleen Vermillera
(74) *Attorney, Agent, or Firm* — The Iwashko Law Firm, PLLC; Lev Ivan Gabriel Iwashko

(57) ABSTRACT

An exercise stick, including a main pole, a tensioning assembly disposed at a substantially center portion of the main pole to move up the main pole in a first direction toward a first end of the main pole, and to move down the main pole in a second direction toward a second end of the main pole, and a handle assembly attached to the tensioning assembly to allow a user to move the tensioning assembly in the first direction and the second direction.

6 Claims, 11 Drawing Sheets

(56) References Cited

U.S. PATENT DOCUMENTS

| | | | | |
|---|---|---|---|---|
| 2004/0235624 | A1* | 11/2004 | Bruce | A63B 21/0087<br>482/125 |
| 2008/0280738 | A1* | 11/2008 | Brennan | A63B 21/04<br>482/129 |
| 2012/0094812 | A1* | 4/2012 | Smiley | A63B 21/0004<br>482/128 |

* cited by examiner

EXERCISE STICK

BACKGROUND

1. Field

The present general inventive concept relates generally to an exercise device, and particularly, to an exercise stick that is portable and effective for strength-training and stretching.

2. Description of the Related Art

There is a plethora of scientific studies available that describe physical, psychological, as well as immune-enhancing benefits of resistive exercise. It is important for individuals to maintain an exercise regimen to keep muscles, connective tissue, and bones strong, which are essential to good, long-term health. However, most exercise equipment is bulky, heavy, and non-portable.

Also, people who are disabled often seek exercise devices that are light-weight, portable, and non-bulky. However, it is difficult to find such devices that also provide ample strength-training functionality.

Therefore, there is a need for effective strength-training equipment that is light-weight, easy to use and transport, can be used in the home or virtually anywhere desired, and requires no weights, springs or bands.

SUMMARY

The present general inventive concept provides a pole for use as a physical therapy or exercise tool with a sliding handle where an angle and a tension of the handle are adjustable.

The pole may further include a pair of foot straps and a door mount strap to stabilize the pole for exercises in a vertical, horizontal, or angular way.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an exercise stick, including a main pole, a tensioning assembly disposed at a substantially center portion of the main pole to move up the main pole in a first direction toward a first end of the main pole, and to move down the main pole in a second direction toward a second end of the main pole, and a handle assembly attached to the tensioning assembly to allow a user to move the tensioning assembly in the first direction and the second direction.

The main pole may be unscrewable and separable into at least two separate portions.

The exercise stick may further include an end cap disposed at the first end of the main pole to prevent the upper resistance band clamp from being removed from the main pole as the upper resistance band clamp moves up the main pole.

The exercise stick may further include a base portion disposed at the second end of the main pole to prevent the lower resistance band clamp from being removed from the main pole as the lower resistance band clamp moves down the main pole.

The exercise stick may further include a plurality of foot straps disposed at the base portion to extend therefrom to allow the user to stand thereon to prevent the exercise stick from moving as the user pushes or pulls on the tensioning assembly.

The exercise stick may further include a door mount assembly disposed at the base portion and connected thereto to allow the exercise stick to be pinched between a door and a door jamb.

The tensioning assembly may increase in tension or decrease in tension based on a tightening of a worm bolt within the tensioning assembly, to cause the tensioning assembly to move more easily along the main pole based on a loosening of the worm bolt or more difficultly along the main pole based on a tightening of the worm bolt.

The exercise stick may further include an upper resistance band clamp disposed between the tensioning assembly and the first end of the main pole to allow a resistance band to be connected between the upper resistance band clamp and the tensioning assembly to provide alternative resistance when moving the tensioning assembly downward along the main pole toward the second end of the main pole, and a lower resistance band clamp disposed between the tensioning assembly and the second end of the main pole to allow another resistance band to be connected between the lower resistance band clamp and the tensioning assembly to provide another alternative resistance when moving the tensioning assembly upward along the main pole toward the first end of the main pole.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1A:
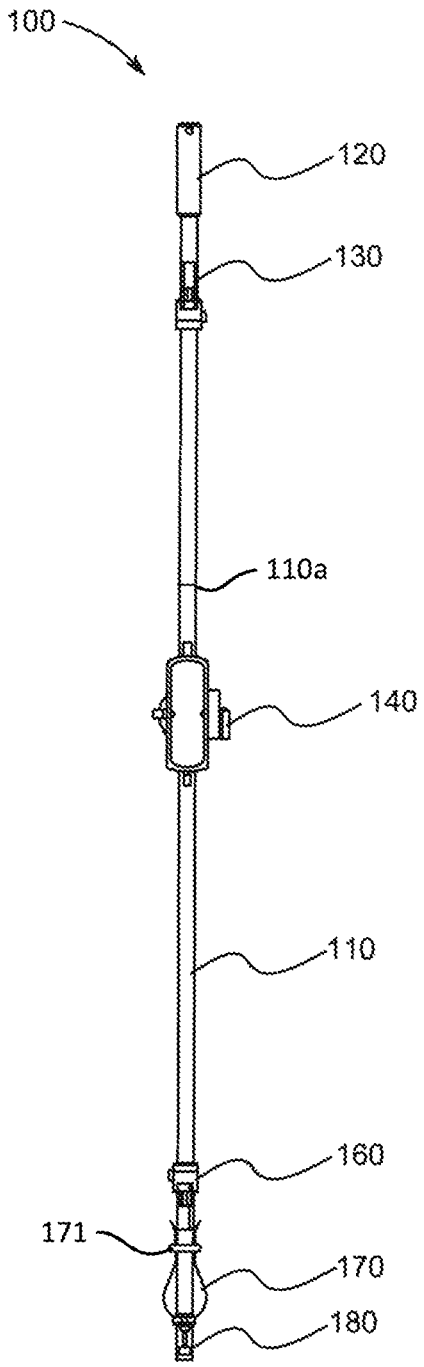
FIG. 1A illustrates a front perspective view of an exercise stick, according to an exemplary embodiment of the present general inventive concept.

FIG. 1A illustrates a front perspective view of an exercise stick 100, according to an exemplary embodiment of the present general inventive concept.

Figure 1B:
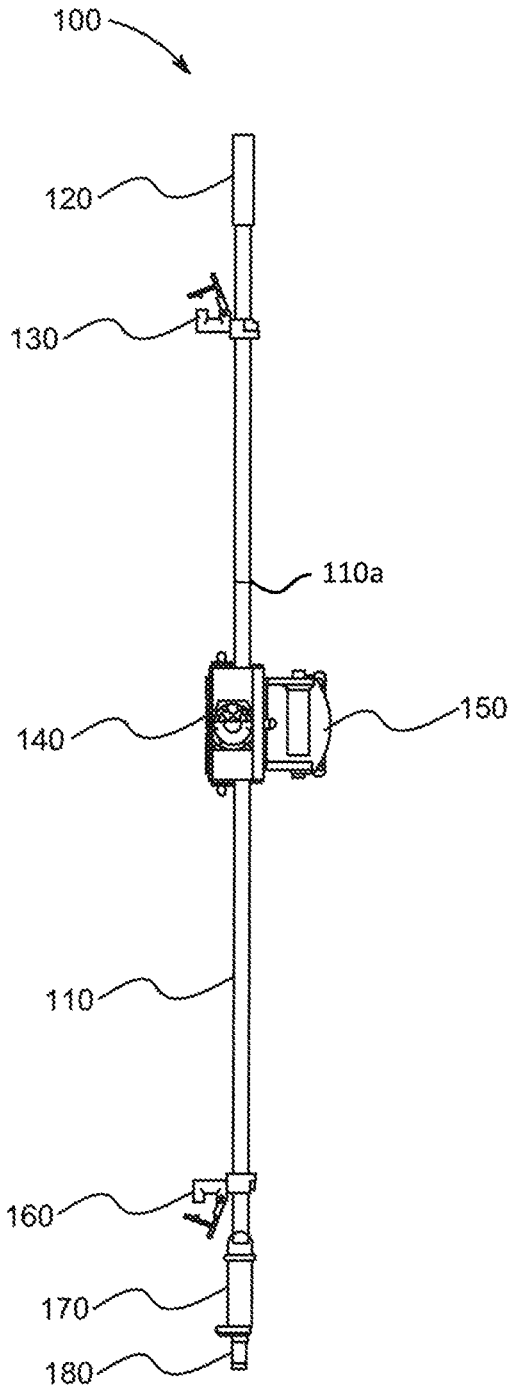
FIG. 1B illustrates a side perspective view of the exercise stick, according to an exemplary embodiment of the present general inventive concept.

FIG. 1B illustrates a side perspective view of the exercise stick 100, according to an exemplary embodiment of the present general inventive concept.

Referring to FIGS. 1A and 1B, the exercise stick 100 may include a main pole 110, an end cap 120, an upper resistance band clamp 130, a tensioning assembly 140, a handle assembly 150, a lower resistance band clamp 160, a plurality of foot straps 170, and a base portion 180.

The main pole 110 may be unscrewed at one, two, or more points, in order to detach the main pole 110 into multiple portions to allow for easy storage of the main pole 110. For example, the main pole 110 may be unscrewed and separated into at least two portions via a separation point 110*a*. In other words, the main pole 110 may be sectional in at least two separate pieces, and may be sectional in more pieces, such as three, four, five, six, etc., or alternatively, the main pole 110 may be a single pole piece.

The main pole 110 may be constructed from metal, plastic, glass, fiberglass, wood, rubber, or any other durable material known to one of ordinary skill in the art, and may have any size (when fully assembled), ranging from one foot to ten feet in length, but is not limited thereto.

The end cap 120 may be disposed at a top end of the main pole 110, and may be included to prevent components installed on the main pole 110 from sliding off the top end of the main pole 110. Also, the end cap 120 may be designed to be slightly smaller than a diameter of the main pole 110 (but is not limited thereto), in order to enable a user to easily install or remove the upper resistance band clamp 130, the tensioning assembly 140, the handle assembly 150, and/or the lower resistance band claim 160.

The upper resistance band clamp 130 may be disposed below the end cap 120 to be movable (i.e., slidable) along the main pole 110.

The tensioning assembly 140 may be disposed on the main pole 110 to be slidable along the main pole 110, such that the tensioning assembly 140 may be easy or difficult to slide along the main pole 110, based on a preference of a user.

The handle assembly 150 may be disposed on the tensioning assembly 140 to allow the user to move (i.e., slide) the tensioning assembly along the main pole 110.

As such, a combination of the tensioning assembly 140 and the handle assembly 150 may allow the user to exert energy when attempting to slide the tensioning assembly 140 along the main pole 110 in various different directions, thereby allowing the user to exercise using the exercise stick 100.

Also, the handle assembly 150 may be adjustable in any direction.

The lower resistance band clamp 160 may be disposed on the main pole 110 below the tensioning assembly 140, and may be slidable along the main pole 110.

The plurality of foot straps 170 may be disposed at a bottom portion of the main pole 110, and may be stored within foot strap holders 171 when the plurality of foot straps 170 are not in use.

The base portion 180 may be disposed at a bottom tip of the main pole 110, and may include a ball tip 181 that may be used to slide into another device, as preferred by the user. The ball tip 181 may be designed to protect a floor from scuff marks or scratches.

Figure 2A:
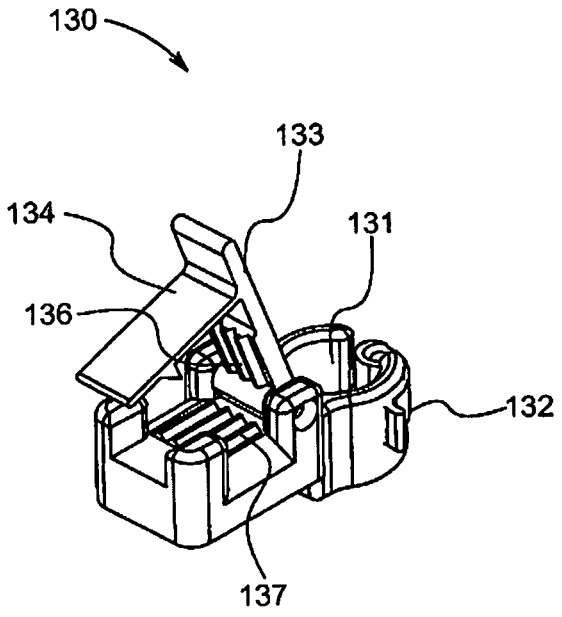
FIG. 2A illustrates a top front angled perspective view of an upper resistance band clamp, according to an exemplary embodiment of the present general inventive concept.

FIG. 2A illustrates a top front angled perspective view of the upper resistance band clamp 130, according to an exemplary embodiment of the present general inventive concept.

Figure 2B:
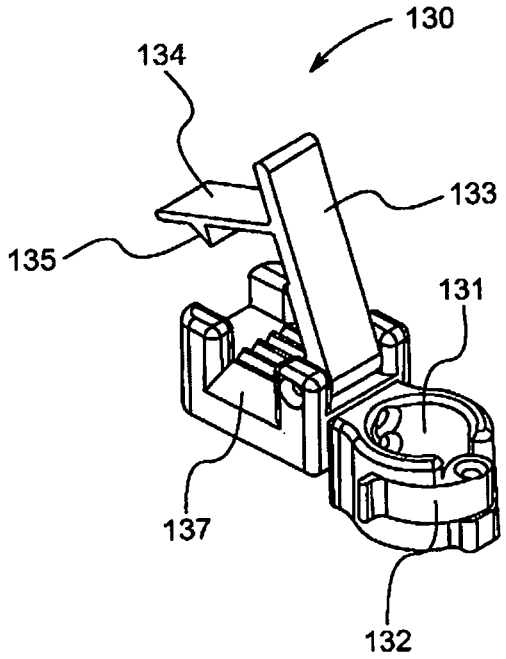
FIG. 2B illustrates a top rear angled perspective view of the upper resistance band clamp, according to an exemplary embodiment of the present general inventive concept.

FIG. 2B illustrates a top rear angled perspective view of the upper resistance band clamp 130, according to an exemplary embodiment of the present general inventive concept.

Figure 2C:
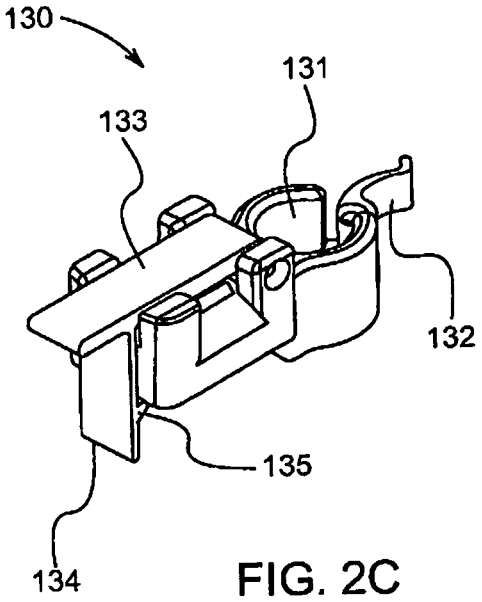
FIG. 2C illustrates another top front angled perspective view of the upper resistance band clamp, according to an exemplary embodiment of the present general inventive concept.

FIG. 2C illustrates another top front angled perspective view of the upper resistance band clamp 130, according to an exemplary embodiment of the present general inventive concept.

Figure 2D:
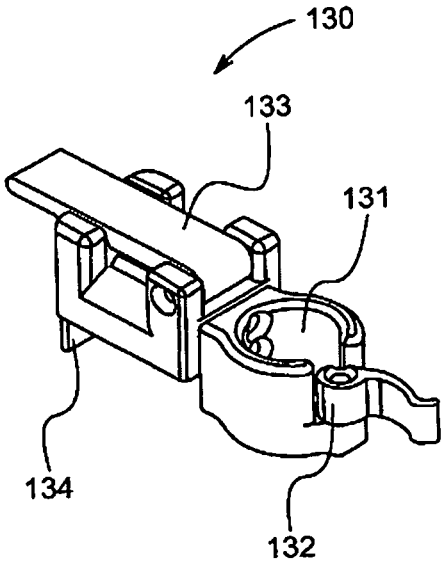
FIG. 2D illustrates another top rear angled perspective view of the upper resistance band clamp, according to an exemplary embodiment of the present general inventive concept.

FIG. 2D illustrates another top rear angled perspective view of the upper resistance band clamp 130, according to an exemplary embodiment of the present general inventive concept.

Referring to FIGS. 2A through 2D, the upper resistance band clamp 130 may include a pole receiving aperture 131, a pole locking clamp 132, a locking lever pivoting bar 133, a locking lever extension 134, a locking lever wedge 135, a plurality of upper ridges 136, and a plurality of lower ridges 137.

The pole receiving aperture 131 may be designed to receive the main pole 110 therein, and may slide up and down the main pole 110.

The pole locking clamp 132 may lock the upper resistance band clamp 130 in place when the pole locking clamp 132 is rotated in a first direction, such that the pole locking clamp 132 remains stationary on the main pole 110. When the pole locking clamp 132 is rotated in a second direction, the pole locking clamp 132 may slide up and down the main pole 110.

The locking lever pivoting bar 133 may include the plurality of upper ridges 136 disposed on a lower surface thereof, and may pivot in a first direction to cause the locking lever extension 134, which is perpendicularly connected to the locking lever pivoting bar 133, to move downward until the plurality of upper ridges 136 contacts the plurality of lower ridges 137. Also, the locking lever wedge 135 may catch on a bottom surface of the upper resistance band clamp 130.

Figure 11A:
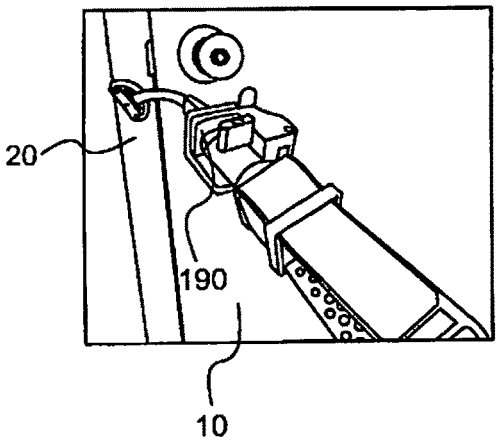
FIG. 11A illustrates a view of the door mount assembly attached between a door and a door jamb, according to an exemplary embodiment of the present general inventive concept.
Figure 11B:
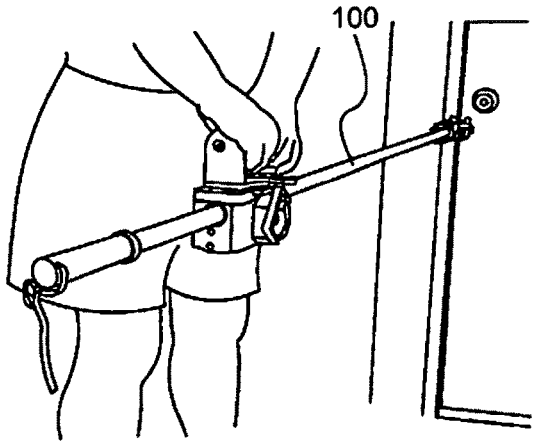
FIG. 11B illustrates another view of the door mount assembly attached between a door and a door jamb, according to an exemplary embodiment of the present general inventive concept.
Figure 11C:
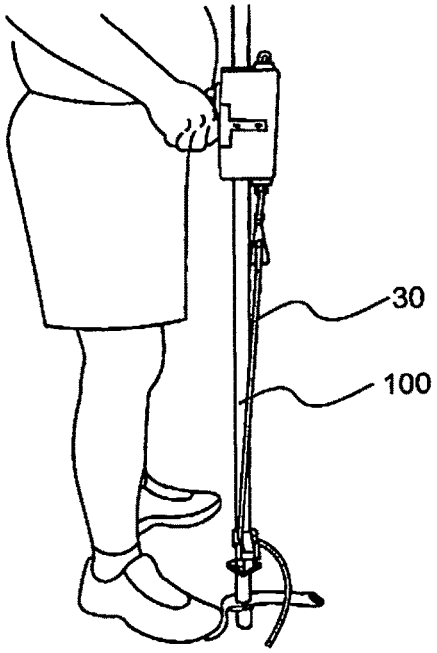
FIG. 11C illustrates a view of the exercise stick being used by a user while standing, according to an exemplary embodiment of the present general inventive concept.

A resistance band 30, as illustrated in FIG. 11C, may be placed between the plurality of upper ridges 136 and the plurality of lower ridges 137, such that the resistance band 30 is pinched (i.e., locked in place) therebetween.

The upper resistance band clamp 130 may have the same components as the lower resistance band clamp 160, and therefore, descriptions of the components of the lower resistance band clamp 160 will be omitted for the sake of brevity.

Figure 3A:
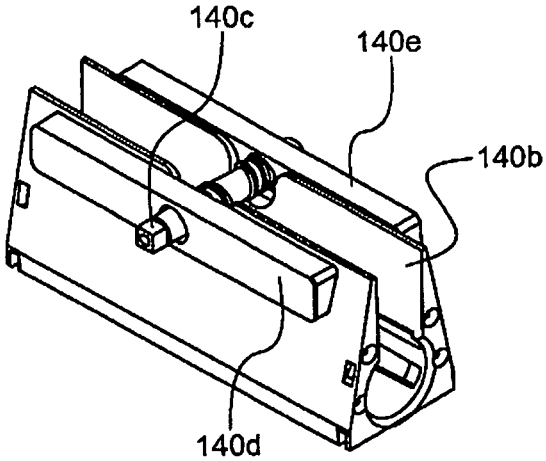
FIG. 3A illustrates a top front angled perspective view of a tension clamp, according to an exemplary embodiment of the present general inventive concept.

FIG. 3A illustrates a top front angled perspective view of a tension clamp 140*b*, according to an exemplary embodiment of the present general inventive concept.

Figure 3B:
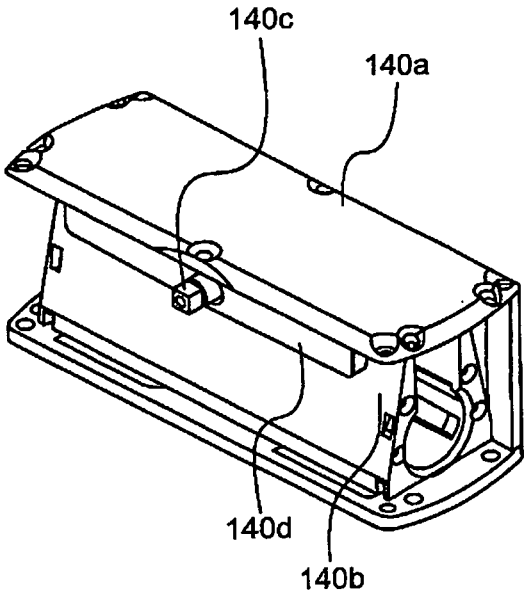
FIG. 3B illustrates a top front angled cross-sectional perspective view of the tension clamp disposed within a tensioning assembly housing, according to an exemplary embodiment of the present general inventive concept.

FIG. 3B illustrates a top front angled cross-sectional perspective view of the tension clamp 140*b* disposed within the tensioning assembly housing 140*a*, according to an exemplary embodiment of the present general inventive concept.

Figure 3C:
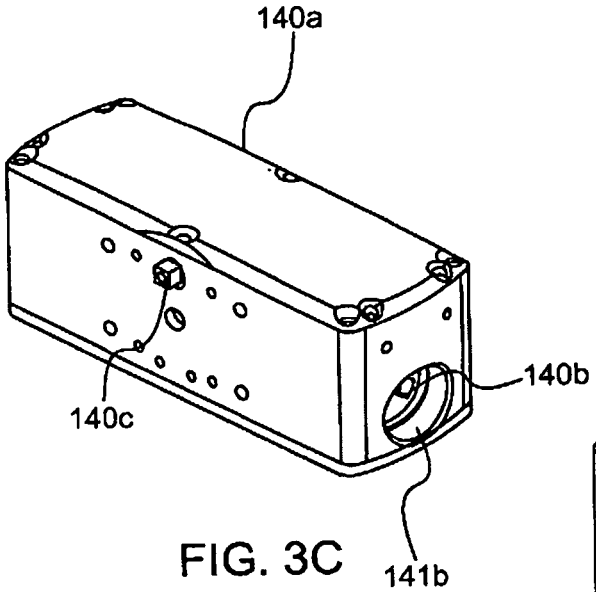
FIG. 3C illustrates a top front angled closed perspective view of the tension clamp disposed within the tensioning assembly housing, according to an exemplary embodiment of the present general inventive concept.

FIG. 3C illustrates a top front angled closed perspective view of the tension clamp 140*b* disposed within the tensioning assembly housing 140*a*, according to an exemplary embodiment of the present general inventive concept.

Figure 3D:
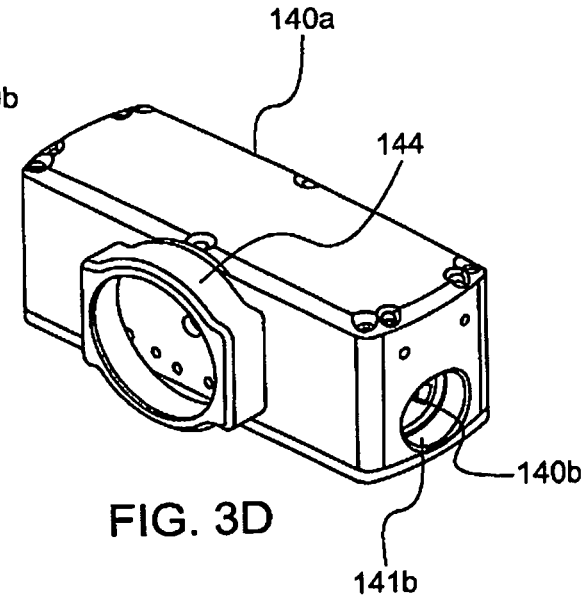
FIG. 3D illustrates a top front angled closed perspective view of the tension clamp disposed within the tensioning assembly housing having a dial assembly disposed thereupon, according to an exemplary embodiment of the present general inventive concept.

FIG. 3D illustrates a top front angled closed perspective view of the tension clamp 140*b* disposed within the tensioning assembly housing 140*a* having the dial assembly 144 disposed thereupon, according to an exemplary embodiment of the present general inventive concept.

Referring to FIGS. 3A through 3D, the tension clamp 140*b* may be formed to have a worm screw 140*c* disposed between two upper surfaces thereof, and held down by a first clamp shoe 140*d* and a second clamp shoe 140*e*. As such, when the worm screw 140*c* is twisted in a first direction, the two upper surfaces of the tension clamp 140*b* may be squeezed together. Therefore, if the tension clamp 140*b* is disposed on the main pole 110, a movement of the tension clamp 140*b* along the main pole 110 becomes more difficult as the worm screw 140*c* continues to be turned such that the two upper surfaces of the tension clamp 140*b* come closer together.

The tensioning assembly housing 140*a* may be disposed around the tension clamp 140*b*, and may include the dial assembly 144 disposed on a front surface thereof, such that the dial assembly 144 covers an end of the worm screw 140*c*.

The upper resistance band clamp 130 and the lower resistance band clamp 160 may allow a user (or a therapist) to vary positions and to achieve desired length of a band 30, as well as spacing of one end of the band 30 and the tension clamp 140*b*. The upper resistance band clamp 130 and the lower resistance band clamp 160 may each include a locking lever so they may be unlocked and moved/relocated to different levels on the main pole 110, locking them with a band of selected resistance.

Figure 4A:
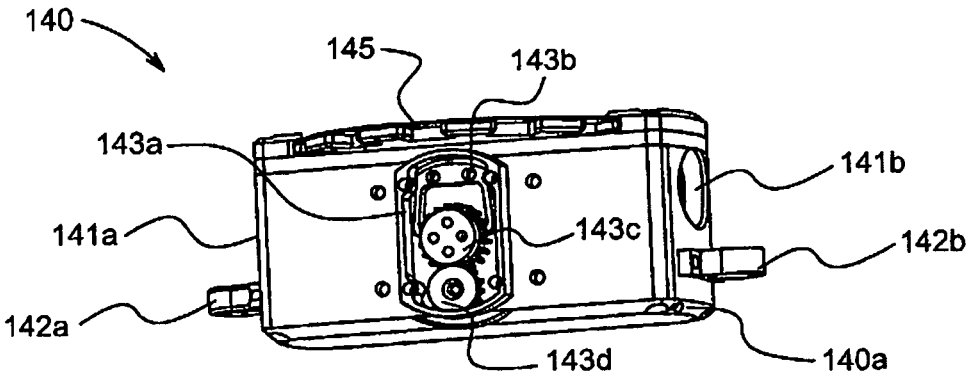
FIG. 4A illustrates a front perspective view of the tensioning assembly, according to an exemplary embodiment of the present general inventive concept.

FIG. 4A illustrates a front perspective view of the tensioning assembly 140, according to an exemplary embodiment of the present general inventive concept.

Figure 4B:
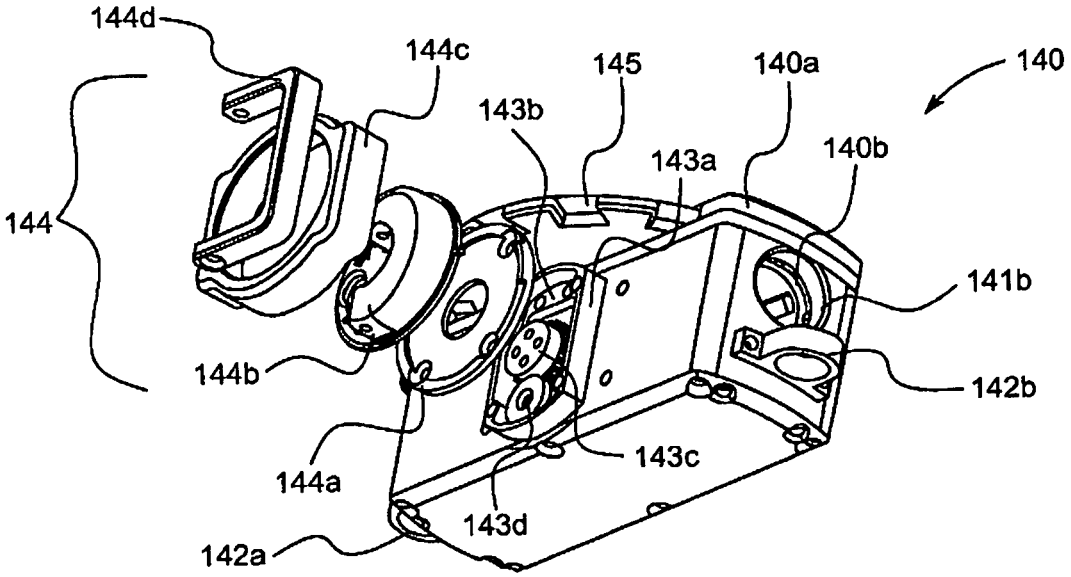
FIG. 4B illustrates a bottom front angled perspective view of the tensioning assembly including an exploded view of the dial assembly, according to an exemplary embodiment of the present general inventive concept.

FIG. 4B illustrates a bottom front angled perspective view of the tensioning assembly 140 including an exploded view of the dial assembly 144, according to an exemplary embodiment of the present general inventive concept.

Figure 4C:
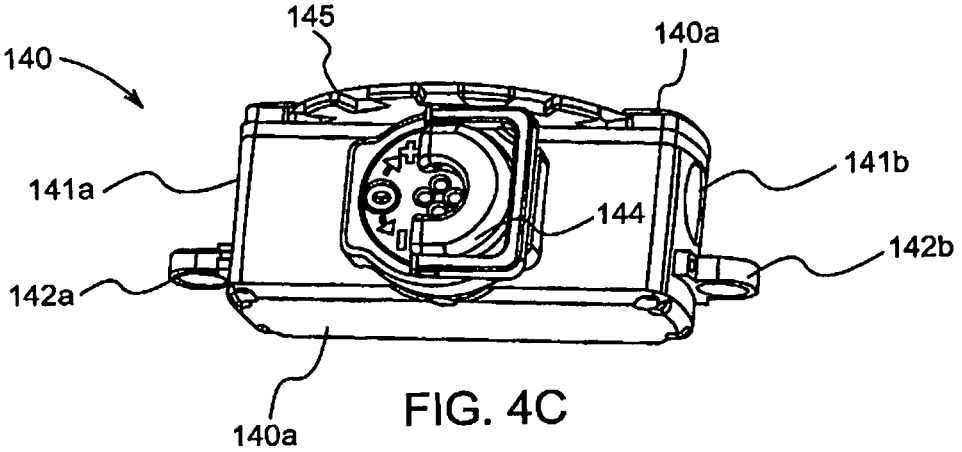
FIG. 4C illustrates a front perspective view of the tensioning assembly including the dial assembly disposed on a tensioning assembly housing, according to an exemplary embodiment of the present general inventive concept.

FIG. 4C illustrates a front perspective view of the tensioning assembly 140 including the dial assembly 144 disposed on the tensioning assembly housing 140*a*, according to an exemplary embodiment of the present general inventive concept.

Referring to FIGS. 4A through 4C, the tensioning assembly 140 may include a housing 140*a*, which includes a first pole aperture 141*a* at a first end of the housing 140*a*, and a second pole aperture 141*b* at a second end of the housing 140*a*.

The tensioning assembly 140 may also include a first resistance band anchor loop 142*a* disposed at the first end of the housing 140*a*, and a second resistance band anchor loop 142*b* disposed at the second end of the housing 140*a*. The first resistance band anchor loop 142*a* may receive a first end of a resistance band 30, such that a second end of the resistance band 30 may be attached to the upper resistance band clamp 130. The second resistance band anchor loop 142*b* may receive a first end of another resistance band 30, such that a second end of the another resistance band 30 may be attached to the lower resistance band clamp 160.

The tensioning assembly 140 may also include, disposed on a front surface thereof, a dial support 143*a*, an indexing clamp 143*b*, a dial cover gear 143*c*, and a worm gear 143*d*.

The dial support 143*a* may receive thereon the dial assembly 144, specifically, first a number dial 144*a*, then a dial cover 144*b*, then a dial cap 144*c*, and a dial handle 144*d*. The number dial 144*a* may be attached to the dial cover gear 143*c*, which is connected to the worm gear 143*d*, such that turning the number dial 144*a* in a first direction or a second direction causes the dial cover gear 143*c* to turn in a first direction or a second direction, thereby causing the worm gear 143*d* to turn in a first direction or a second direction, which causes the worm screw 140*c* to turn and either tighten or loosen the two upper surfaces of the tension clamp 140*b* around the main pole 110. When the dial cover gear 143*c* turns in a first direction, the worm gear 143*d* turns in a direction opposite from the first direction of the turning dial cover gear 143*c*.

Figure 5A:
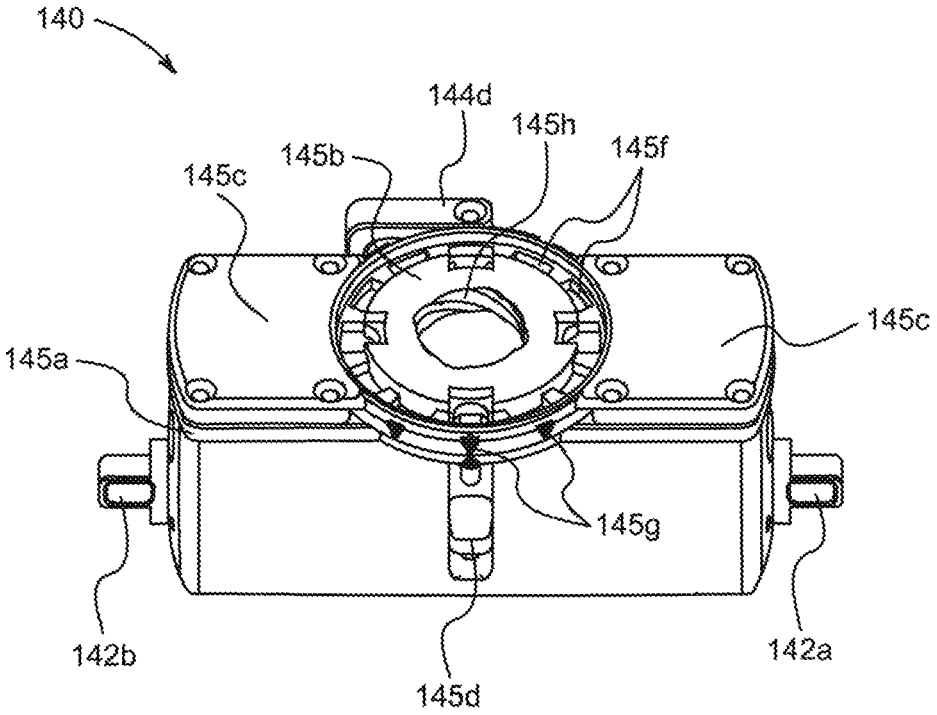
FIG. 5A illustrates a front angled perspective view of a wheel sub assembly, according to an exemplary embodiment of the present general inventive concept.

FIG. 5A illustrates a front angled perspective view of the wheel sub assembly 145, according to an exemplary embodiment of the present general inventive concept.

Figure 5B:
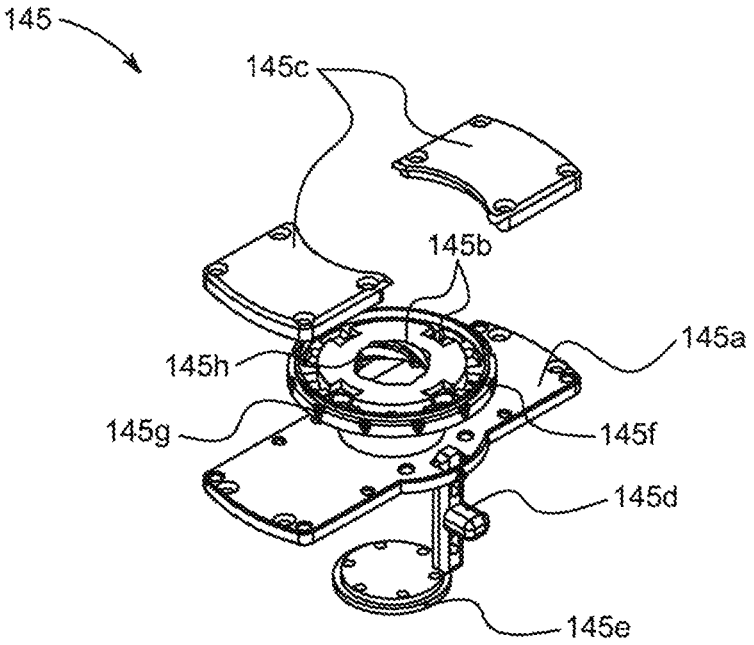
FIG. 5B illustrates a top angled exploded perspective view of the wheel sub assembly, according to an exemplary embodiment of the present general inventive concept.

FIG. 5B illustrates a top angled exploded perspective view of the wheel sub assembly 145, according to an exemplary embodiment of the present general inventive concept.

Figure 6:
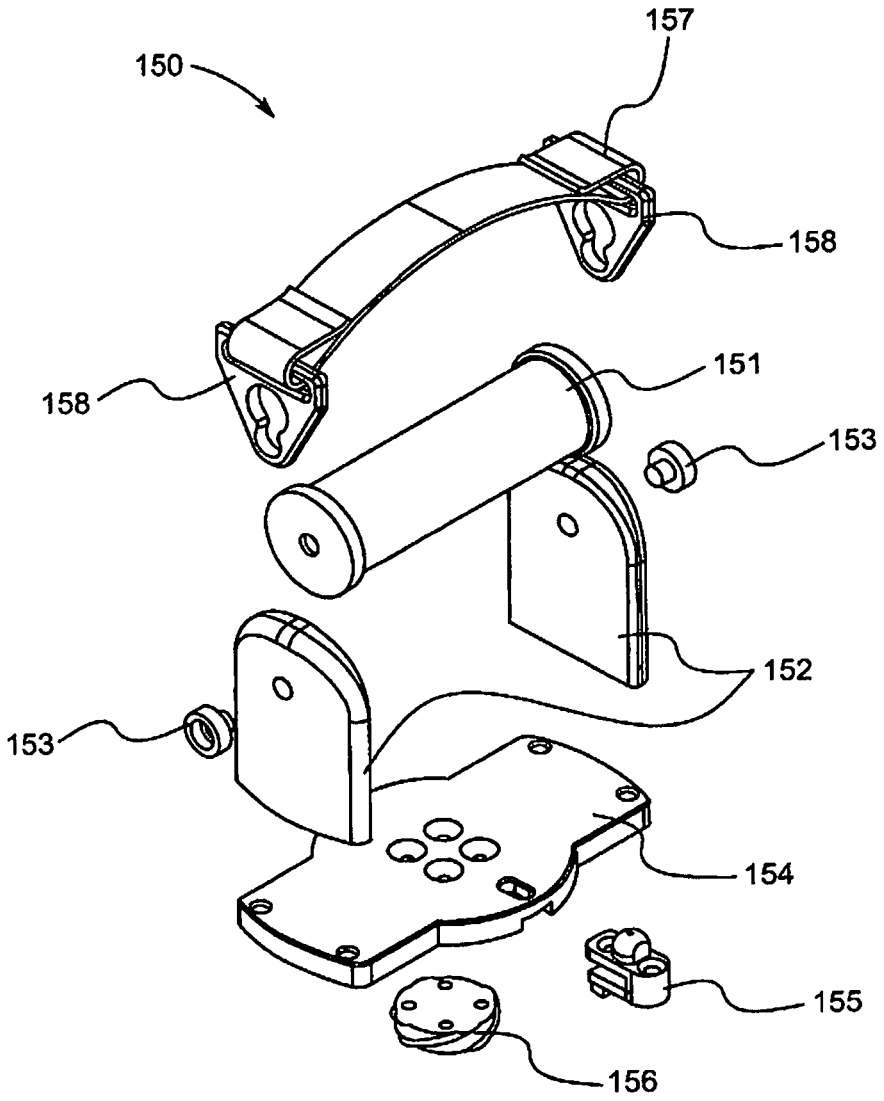
FIG. 6 illustrates a top angled exploded perspective view of a handle assembly, according to an exemplary embodiment of the present general inventive concept.

Referring to FIGS. 5A and 5B, the wheel sub assembly 145 may include a housing top 145*a* disposed on the housing 140*a* of the tensioning assembly 140, a wheel 145*b* disposed on the housing top 145*a*, a plurality of housing caps 145*c* to prevent the wheel 145*b* from being removed from the housing top 145*a*, a wheel lock lever 145*d* extending downward from the housing top and connected to the housing 140*a* to prevent the wheel 145*b* from moving by sliding upwards into one of a plurality of wheel slots 145*f*, a wheel plug 145*e* to connect to the wheel 145*b* from underneath the housing top 145*a*, a plurality of locating marks 145*g* disposed around a circumference of the wheel 145*b* to annotate where the wheel slots 145*f* are located, and a threaded aperture 145*h* disposed at a center portion of the wheel 145*b* to accept a threaded base 156 of the handle assembly 150, as illustrated in FIG. 6.

FIG. 6 illustrates a top angled exploded perspective view of the handle assembly 150, according to an exemplary embodiment of the present general inventive concept.

Referring to FIG. 6, the handle assembly 150 may include a handle tubing 151 (preferably at least partially constructed from non-slip material) that is attached at two ends thereof to two handle arms 152 by two caps 153. The two handle arms 152 may each be attached at base portions thereof to a handle base 154, which may be attached to the threaded aperture 145*h* of the wheel 145*b* via the threaded base 156, which may be locked to the wheel 145*b* using a sliding handle lock 155.

An adjustable strap 157 may be attached at side portions thereof, the side portions that each contain a removable strap holder 158, to the two caps 153.

As such, the handle assembly 150 may be attached to the wheel sub assembly 145 of the tensioning assembly 140.

Figure 7:
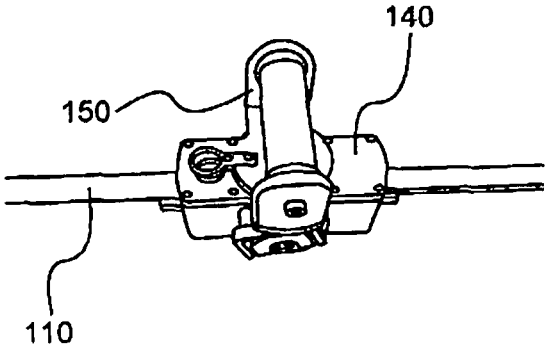
FIG. 7 illustrates a rear angled perspective view of the handle assembly disposed on the tensioning assembly as disposed on the main pole, according to an exemplary embodiment of the present general inventive concept.

FIG. 7 illustrates a rear angled perspective view of the handle assembly 150 disposed on the tensioning assembly 140 as disposed on the main pole 110, according to an exemplary embodiment of the present general inventive concept.

Referring to FIG. 7, it is clear that the tensioning assembly 140 may slide along the main pole 110 when a user grabs and pulls on the handle assembly 150.

Figure 8A:
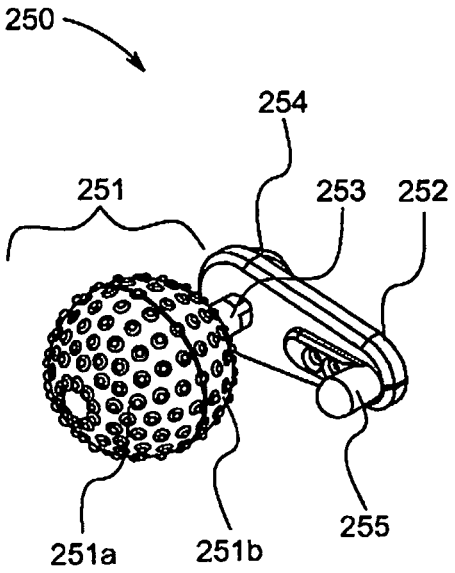
FIG. 8A illustrates a front angled perspective view of a handle assembly, according to another exemplary embodiment of the present general inventive concept.

FIG. 8A illustrates a front angled perspective view of a handle assembly 250, according to another exemplary embodiment of the present general inventive concept.

Figure 8B:
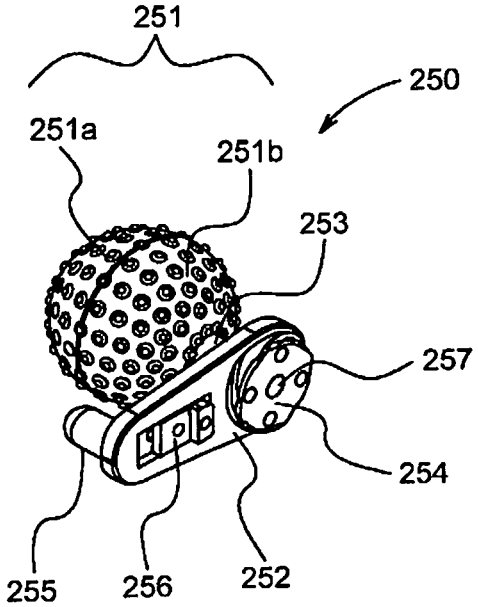
FIG. 8B illustrates a rear angled perspective view of the handle assembly, according to another exemplary embodiment of the present general inventive concept.

FIG. 8B illustrates a rear angled perspective view of the handle assembly 250, according to another exemplary embodiment of the present general inventive concept.

Figure 8C:
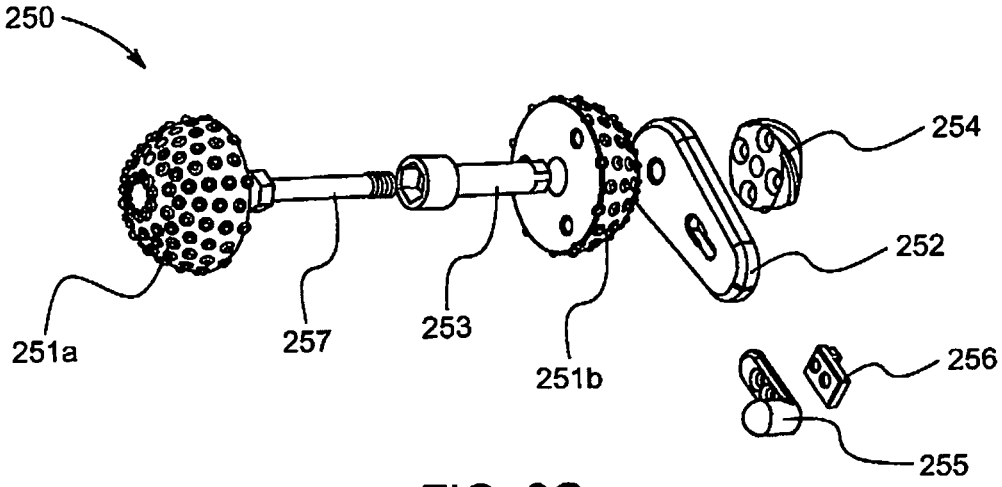
FIG. 8C illustrates a side exploded perspective view of the handle assembly, according to another exemplary embodiment of the present general inventive concept.

FIG. 8C illustrates a side exploded perspective view of the handle assembly 250, according to another exemplary embodiment of the present general inventive concept.

Referring to FIGS. 8A through 8C, the handle assembly 250 may include a ball 251, which includes a first half ball 251*a* and a second half ball 251*b*, which may have a plurality of rained bumps on surfaces thereof to promote gripping of the ball 251. The first half ball 251*a* may have a bolt 257 attached to an inner portion thereof to connect to an attachment member 253 disposed on an inner portion of the second half ball 251*b*, which may connect the ball 251 to a ball handle 252.

A peg 255 may be attached to an end of the ball handle 252 opposite from an end at which the ball 251 is attached, in order to connect the handle assembly 250 to the wheel 145*b* via a threaded base 254. A sliding lever lock 256 may lock the threaded base 254 to the wheel 145*b*, and may be locked and/or unlocked for each of use.

Figure 9:
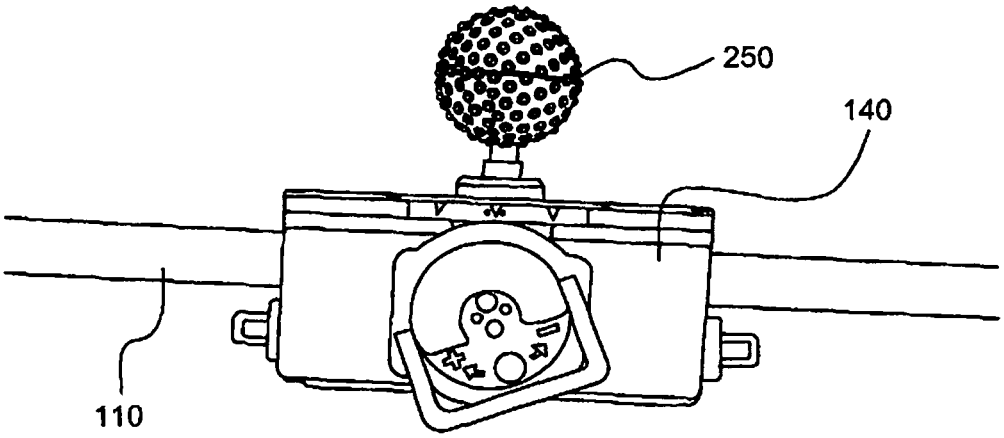
FIG. 9 illustrates a front perspective view of the handle assembly disposed on the tensioning assembly as disposed on the main pole, according to another exemplary embodiment of the present general inventive concept.

FIG. 9 illustrates a front perspective view of the handle assembly 250 disposed on the tensioning assembly 140 as disposed on the main pole 110, according to another exemplary embodiment of the present general inventive concept.

Referring to FIG. 9, it is clear that the tensioning assembly 140 may slide along the main pole 110 when a user grabs and pulls and/or pushes on the handle assembly 250.

Figure 10:
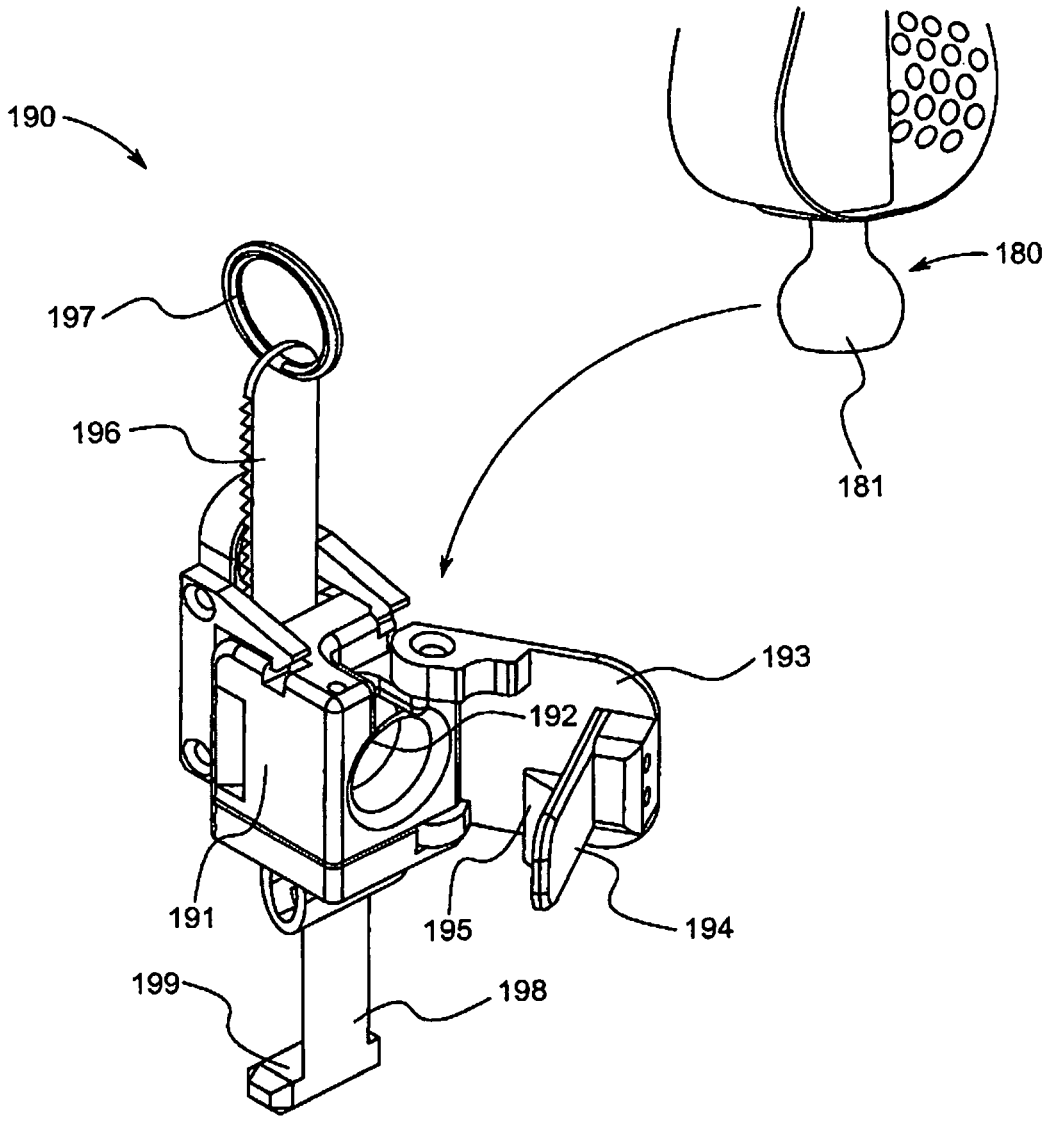
FIG. 10 illustrates a top angled perspective view of a door mount assembly, according to an exemplary embodiment of the present general inventive concept.

FIG. 10 illustrates a top angled perspective view of a door mount assembly 190, according to an exemplary embodiment of the present general inventive concept.

The door mount assembly 190 may be included in order to position the exercise stick 100 in various horizontal and/or angular positions with respect to the user and/or the floor.

Referring to FIG. 10, the door mount assembly 190 may include a main body 191, a ball receiving aperture 192, a clamp door 193, a clamp foot 194, a clamp wedge 195, a notched ribbon 196, a pull ring 197, a mounting ribbon 198, and a butt end 199.

The ball tip 181 of the base portion 180 of the exercise stick 100 may be placed into the ball receiving aperture 192, and then the clamp door may pivotably close the ball tip 181 within the ball receiving aperture 192 such that the clamp wedge 195 disposed at a tip of the clamp foot 194 may catch onto a portion of the main body 191 to maintain the ball tip 181 within the ball receiving aperture 192.

The mounting ribbon 198 may be attached to the notched ribbon 196, such that pulling the pull ring 197 may cause both the notched ribbon 196 and the mounting ribbon 198 to move within the main body 191.

The mounting ribbon 198 may be placed between a door and a door jamb, such that the butt end 199 remains on a side of the door opposite of where the user is standing, such that pulling on the exercise stick 100 does not cause the exercise stick to move away from the area between the door and the door jamb.

FIG. 11A illustrates a view of the door mount assembly 190 attached between a door 10 and a door jamb 20, according to an exemplary embodiment of the present general inventive concept.

FIG. 11B illustrates another view of the door mount assembly 190 attached between a door 10 and a door jamb 20, according to an exemplary embodiment of the present general inventive concept.

FIG. 11C illustrates a view of the exercise stick 100 being used by a user while standing, according to an exemplary embodiment of the present general inventive concept.

Figure 11D:
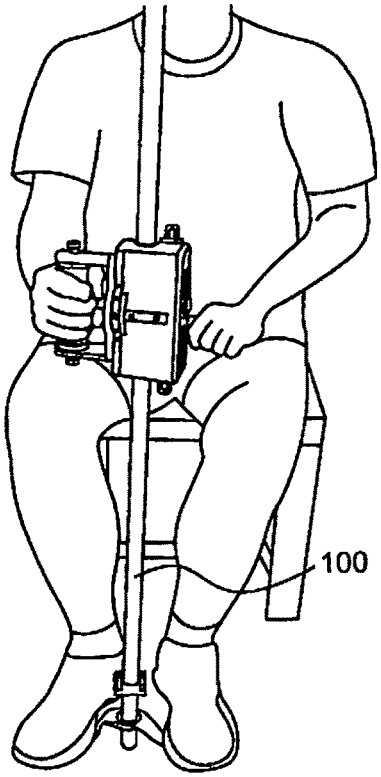
FIG. 11D illustrates a view of the exercise stick being used by a user while seated, according to an exemplary embodiment of the present general inventive concept.

FIG. 11D illustrates a view of the exercise stick 100 being used by a user while seated, according to an exemplary embodiment of the present general inventive concept.

As illustrated in FIGS. 11A through 11D, the exercise stick 100 may be used by the user when the user steps on the plurality of foot straps, or alternatively, places the mounting ribbon 198 between the door 10 and the door jamb 20, and then pulls on and/or pushes the handle assembly 150 such that the tensioning assembly 140 may slide along the main pole 110. As stated above, the resistance band(s) 30 may be added between the tensioning assembly 140 and the upper resistance band clamp 130 and/or the lower resistance band clamp 160, in order to provide the user with alternative, additional, and/or optional resistance when sliding the tensioning assembly 140 along the main pole 110. In other words, the upper resistance band clamp 130 and/or the lower resistance band clamp 160 may allow the user to feel alternating muscle groups activated as the user pushes and pulls on the handle assembly 150.

The main purpose of the exercise stick 100 is to provide individuals exercise equipment/a device that requires no weights, bands or springs. The exercise stick 100 provides adjustable resistive force to challenge and strengthen muscles, similar to strengthening encountered from lifting progressively heavier free-weights or by using weighted gym equipment, such as that found in health clubs. As stated above, there is a plethora of scientific studies available that describe physical, psychological, as well as immune-enhancing benefits of resistive exercise. The exercise stick 100 helps individuals partake in an exercise regimen to keep muscles, connective tissue, and bones strong, which are essential to good, long-term health. The exercise stick 100 offers individuals effective strength-training equipment that is light-weight, easy to use, and easy to transport. Furthermore, the exercise stick 100 can be used in the home or virtually anywhere desired, and requires no weights, springs or bands, but may include tension bands for extra resistance if desired. The exercise stick 100 can be used in vertical, horizontal or angular ways, and has a graded resistance available to customize resistive tension for each person and exercise. The exercise stick 100 could prove to be a vital exercise tool for those needing rehab equipment or those who simply want an effective low-cost alternative to gym equipment, club memberships, etc., that is easy to use and travels well.

Of further importance, is that the exercise stick 100 is naturally low-impact and very safe since it uses no heavy weights which have a number of inherent dangers, and requires no bands or springs which can cause injury when unexpectedly breaking or snapping back. Also, users of the exercise stick 100 can stop any movement abruptly with no danger, and they can regulate and select the exercise tension to their preference. They will not risk equipment malfunction or endanger themselves by selecting too high a resistance.

Weights and dumbbells provide long-term progressive resistance exercise, and one can merely select increasingly heavier weights over time to continue to challenge each muscle group. The exercise stick 100 introduces a resilient workout apparatus that individuals can use over many years to exercise, tone and strengthen virtually all arm, leg and core muscles in a progressive fashion similar to that when utilizing free-weights.

Individuals can shorten duration of workout sessions because the exercise stick 100 works the antagonist muscle immediately, in a fraction of a second, after the agonist is worked, with no equipment setup change needed, (for example the bicep is worked immediately following the triceps). This applies to all muscle groups and movements performed with exercise stick 100. Because of its adjustability, the exercise stick 100 can be employed throughout all stages of rehabilitation, and may also be used for long-term exercise and strength-training.

The exercise stick 100 is the only product of its kind to provide a versatile exercise device to assist users at any stage of life, to promote health and well-being. The exercise stick 100 is both a useful rehabilitation tool as well as well as general strengthening equipment. It is uniquely designed to be able to be split into multiple equal parts, offering convenience when transporting or storing. It may also include a padded carrying/storage case to allow for convenient storage and transport of the exercise stick 100, and the case may include separate compartments for storage of all of the components of the exercise stick 100.

The exercise stick 100 may be designed to allow various different muscle groups to be activated during use, based on a change of an angle of the handle assembly 150 with respect to the user. Also, adjustability of the tension of the exercise stick 100 may allow a therapist and a user to monitor and note clear definable strength changes over time and/or over the course of therapy intervention. Changing the tension grade by increasing or decreasing it enables therapists and users to limit, or intensify strengthening. Higher numbers on the dial 144*a* may indicate the patient is performing at a higher/stronger level (which may be important for documentation purposes of therapists so they may demonstrate a patient's/client's progress, to keep physicians informed or for verifying progress to insurers when submitting for reimbursement, and to justify for an attending physician or payer the appropriateness to continue or stop therapy). In some cases (depending on stage of healing) the physician may want the patient to not overstress a muscle or tendon that they have surgically altered or repaired (for example, tendons have less or greater tensile strength at different stages/times following surgery/repair).

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An exercise stick, comprising:

a main pole;

a tensioning assembly disposed at a center portion of the main pole configured to move up the main pole in a first direction toward a first end of the main pole, and configured to move down the main pole in a second direction toward a second end of the main pole;

a handle assembly attached to the tensioning assembly configured to allow a user to move the tensioning assembly in the first direction and the second direction;

a base portion, including a ball tip, disposed at the second end of the main pole configured to prevent the tensioning assembly from being removed from the main pole as the tensioning assembly moves down the main pole; and a door mount assembly disposed at the base portion and connected thereto configured to allow the exercise stick to be pinched between a door and a door jamb, the door mount assembly comprising:

a main body, a ball receiving aperture disposed within at least a portion of the main body to receive the ball tip therein, a clamp door pivotably disposed on at least a portion of the main body, a clamp foot disposed on at least a portion of the clamp door, and a clamp wedge disposed at a tip of the clamp foot to catch onto a portion of the main body to maintain the ball tip within the ball receiving aperture.

2. The exercise stick of claim 1, wherein the main pole is unscrewable and separable into at least two separate portions.

3. The exercise stick of claim 1, further comprising:

an end cap disposed at the first end of the main pole configured to prevent the tensioning assembly from being removed from the main pole as the tensioning assembly moves up the main pole.

4. The exercise stick of claim 1, further comprising:

a plurality of foot straps disposed at the base portion and extending therefrom configured to allow the user to stand thereon to prevent the exercise stick from moving as the user pushes or pulls on the tensioning assembly.

5. The exercise stick of claim 1, wherein the tensioning assembly increases in tension or decreases in tension based on a tightening of a worm bolt within the tensioning assembly, thereby causing the tensioning assembly to move more easily along the main pole based on a loosening of the worm bolt or more difficultly along the main pole based on a tightening of the worm bolt.

6. The exercise stick of claim 1, further comprising:

an upper resistance band clamp disposed between the tensioning assembly and the first end of the main pole configured to allow a resistance band to be connected between the upper resistance band clamp and the tensioning assembly to provide alternative resistance when moving the tensioning assembly downward along the main pole toward the second end of the main pole; and a lower resistance band clamp disposed between the tensioning assembly and the second end of the main pole configured to allow another resistance band to be connected between the lower resistance band clamp and the tensioning assembly to provide another alternative resistance when moving the tensioning assembly upward along the main pole toward the first end of the main pole.

* * * * *